US009209526B2

(12) United States Patent
Gao et al.

(10) Patent No.: US 9,209,526 B2
(45) Date of Patent: Dec. 8, 2015

(54) BROADBAND DUAL-POLARIZED OMNI-DIRECTIONAL ANTENNA AND FEEDING METHOD USING THE SAME

(75) Inventors: Feng Gao, Beijing (CN); Huaxing Ma, Beijing (CN); Peng Gao, Beijing (CN); Yuan Jiang, Beijing (CN); Jiwei He, Beijing (CN); Wentao Zhu, Beijing (CN); Xu Liu, Beijing (CN); Dongchen Zhang, Beijing (CN)

(73) Assignee: CHINA MOBILE GROUP DESIGN INSTITUTE CO., LTD., Beijing (CN)

( * ) Notice: Subject to any disclaimer, the term of this patent is extended or adjusted under 35 U.S.C. 154(b) by 248 days.

(21) Appl. No.: 13/878,142

(22) PCT Filed: Oct. 8, 2011

(86) PCT No.: PCT/CN2011/080528
§ 371 (c)(1),
(2), (4) Date: Apr. 5, 2013

(87) PCT Pub. No.: WO2012/045278
PCT Pub. Date: Apr. 12, 2012

(65) Prior Publication Data

US 2013/0215832 A1 Aug. 22, 2013

(30) Foreign Application Priority Data

Oct. 8, 2010 (CN) ..... 2010 1 0504764

(51) Int. Cl.
*H01Q 21/26* (2006.01)
*H01Q 9/26* (2006.01)

(52) U.S. Cl.
CPC . *H01Q 21/26* (2013.01); *H01Q 9/26* (2013.01)

(58) Field of Classification Search
CPC ..... H01Q 21/26; H01Q 9/26
USPC ..... 343/793, 797, 799, 803, 727, 700 MS
See application file for complete search history.

(56) References Cited

U.S. PATENT DOCUMENTS 4,814,777 A * 3/1989 Monser ..... 343/727
6,356,246 B1 * 3/2002 Nakamura et al. ..... 343/911 R (Continued)

FOREIGN PATENT DOCUMENTS

CN 101694904 A 4/2010
CN 101728645 A 6/2010
CN 101777704 A 7/2010

OTHER PUBLICATIONS

International Search Report dated Jan. 6, 2012 corresponding to International application No. PCT/CN2011/080528.

*Primary Examiner* — Dieu H Duong
(74) *Attorney, Agent, or Firm* — Nath, Goldberg & Meyer; Jerald L. Meyer; Rury L. Grisham

(57) ABSTRACT

A broadband dual-polarized omni-directional antenna and a feeding method using the same are provided. By setting a vertically polarized antenna and a horizontally polarized antenna each in co-axial, the horizontally polarized antenna is attached to an upper surface and a lower surface of the attaching plate respectively by two arms of a folded dipole and the two arms connect to an inner conductor and an outer conductor of a feed line so that the dual-polarized antenna may have a comparatively broad bandwidth. At the same time, since the dual-polarized ceiling antenna has a good isolation effect and coverage balance, it may work as the MIMO antenna in the LTE and WLAN systems effectively and may be used in the 2G and 3G networks to improve the data transmission rate.

12 Claims, 6 Drawing Sheets

(56) References Cited

U.S. PATENT DOCUMENTS

2002/0084943 A1* 7/2002 Tsai et al. ..... 343/795
2005/0237258 A1* 10/2005 Abramov et al. ..... 343/834
2008/0129640 A1 6/2008 Shtrom et al.
2010/0302117 A1* 12/2010 Johnson ..... 343/803

* cited by examiner

BROADBAND DUAL-POLARIZED OMNI-DIRECTIONAL ANTENNA AND FEEDING METHOD USING THE SAME

CROSS-REFERENCE TO RELATED APPLICATION

This is a National Phase Application filed under 35 U.S.C. §371 as a national stage of International application Ser. No. PCT/CN2011/080528, filed Oct. 8, 2011, claiming the benefit from Chinese patent application Ser. No. 201010504764.6, filed Oct. 8, 2010, the entire content of each of which is hereby incorporated by reference in its entirety.

BACKGROUND OF THE INVENTION

1. Field of the Invention

This invention relates to a mobile communication field, and more particularly to a broadband dual-polarized omni-directional antenna (BDOA) and a feeding method using the same.

2. Description of the Prior Art

In the Advanced International Mobile Telecommunication (IMT-Advanced) system, both the Time Division Duplexing (TDD) and the Frequency Division Duplexing (FDD) use the Multi-Input-Multi-Output (MIMO) antenna technology.

According to the MIMO antenna technology, multiple transmitting antennas and multiple receiving antennas are used at the transmitting side and the receiving side respectively. The radio signal is transmitted and received through the multiple antennas at the transmitting side and the receiving side so as to improve the quality of service (such as bit error rate or data speed) for each user. For the traditional Single-Input-Single-Output (SISO) antenna system, MOMO antenna system may improve the frequency spectrum utilizing rate and make it possible to provide higher speed data services with limited radio frequency bands.

According to the practical requirement for the MIMO antenna system, the MIMO antenna array may take the form of 2×2 or 4×4 and the mono-polarized antenna or dual-polarized antenna may be used as the array unit for the MIMO antenna system. The mono-polarized antenna refers to the one with dipoles arranging into one column in the same direction and receiving the radio signal from one direction. The mono-polarized antenna may be vertically polarized, horizontally polarized or ±45° polarized with respect to the datum level. The dual-polarized antenna refers to the one with dipoles arranging into two columns in two directions and receiving the radio signals from two directions. Two inner dipoles of the dual-polarized antenna may be polarized differently. For example, one dipole may be horizontally polarized (horizontally polarized antenna) and the other dipole may be vertically polarized (vertically polarized antenna); or one dipole may be ±45° polarized (±45° antenna) and the other dipole may be −45° polarized (−45° antenna).

According to the directionality of the antenna(s), there may be the omni-directional antenna and the directional antenna. The omni-directional antenna refers to the one without the maximum direction when transmitting and receiving radio signal in the horizontal plane, which has a comparatively low antenna gain and a comparatively short transmission distance of the radio signal. Therefore, the omni-directional antenna is mainly adapted to use in a point to multi-point environment which does not have a strict requirement on transmission distance, for example in the indoor environment. Compared with the omni-directional antenna, the directional antenna has the advantages of good directionality, concentration of energy in a specific direction, high gain, comparatively long transmission distance, comparatively strong anti-interference ability and is more adapted to use in a long distance point-to-point communication. The disadvantages of the directional antenna are small coverage, difficult in mounting and adjusting, and requiring the antennas at the two transmission points to be aligned so as to guarantee the transmission of the radio signal.

The current MIMO antenna system is mainly designed for outdoor environment. For the indoor environment, the MIMO antenna system is designed to generally include a plurality of mono-polarized omni-directional antennas that are vertically polarized because of the complexity of the environment and the requirement of a comparatively broadband coverage.

In the current indoor MIMO antenna system that adopts the mono-polarized omni-directional antenna as the array unit, since the frequency utilization rate of the mono-polarized antenna is low, the data transmission rate is comparatively low. In addition, in order to guarantee the high capacity of the indoor MIMO antenna system, the number of the mono-polarized antennas is required to be comparatively large, which leads to a comparatively large occupation of space by the indoor MIMO antenna system. Therefore, an omni-directional antenna that may improve the frequency utilization rate and occupy a comparatively small space is needed to work as the array unit of the indoor MIMO antenna system.

Considering that the dual-polarized omni-directional antenna may separate overlapped frequencies compared with the mono-polarized omni-directional antenna and improve the frequency utilization rate, it is proposed to use the dual-polarized omni-directional antenna as the array unit for the indoor MIMO antenna system, which may improve the frequency utilization rate while occupying a comparatively small space. As shown in FIG. 1, which is a schematic diagram showing a structure of a dual-polarized omni-directional antenna, the dual-polarized omni-directional antenna has one vertically polarized antenna 1 and four horizontally polarized antennas 2. The working frequency of the antenna ranges from 225 MHz to 400 MHz. Therefore, compared with the mono-polarized omni-directional antenna, although the dual-polarized omni-directional antenna may improve the frequency utilization rate and the MIMO antenna system constituted by the dual-polarized omni-directional antenna occupies a reduced space, the dual-polarized omni-directional antenna can hardly be used in the mobile communication system because of the dual-polarized omni-directional antenna working at a comparatively low frequency and a comparative ovality of the horizontal polarization.

Besides the above problems of the MIMO antenna, in the $3^{rd}$ generation (3G, i.e. TD-SCDMA, WCDMA and CDMA2000) mobile communication system, the indoor antenna still uses the mono-polarized antenna as the $2^{nd}$ generation (2G) mobile communication system. However, since the 3G system has a comparatively high frequency, the coverage distance of the mono-polarized antenna using the single channel mode is greatly reduced and the number of the antennas has to be multiplied to compensate for the reduction of the coverage distance. The dual-polarized omni-directional (ceiling) antenna using the dual channel mode may meet the coverage requirement of the network with the same number of antennas as that of the 2G network by utilizing the polarization gain effect of the polarization diversity. However, the current dual-polarized omni-directional (ceiling) antenna still works at a comparatively narrow frequency band.

Therefore, a dual-polarized omni-directional antenna that works at a comparatively broad frequency band is needed, which may improve the frequency utilization rate while guaranteeing the frequency band coverage rate so that the dualpolarized omni-directional antenna may improve the data transmission rate while occupying a comparatively small space.

SUMMARY OF THE INVENTION

Embodiments of the present disclosure provides a broadband dual-polarized omni-directional antenna and a feeding method using the same in order to solve problems such as a short distance of coverage and a comparatively low data transmission rate of a traditional dual-polarized omni-directional antenna.

A broadband dual-polarized omni-directional antenna is provided. The broadband dual-polarized omni-directional antenna includes a vertically polarized antenna 20 and a horizontally polarized antenna 30 each set in co-axial; the horizontally polarized antenna 30 includes an attaching plate 32 and a folded dipole 31 attached to the attaching plate 32 for receiving and transmitting electromagnetic waves; two arms of the folded dipole 31 are attached to an upper surface and a lower surface of the attaching plate 32 respectively, with one arm connecting to an inner conductor of a first feed line and the other arm connecting to an outer conductor the first feed line.

A feeding method using a broadband dual-polarized omni-directional antenna is also provided. The method includes: using the horizontally polarized antenna to receive and transmit horizontal polarized waves; using the vertically polarized antenna to receive and transmit vertical polarized waves.

According to the present disclosure, the horizontally polarized antenna and the vertically polarized antenna are set co-axially; the vertically polarized antenna is attached to the upper surface and the lower surface of the attaching plate by the two arms of the folded dipole and the two arms are connected to the inner conductor and the outer conductor of the first feed line respectively. Therefore, the broadband dual-polarized omni-directional antenna according to the present disclosure may work at a wider frequency band than the traditional broadband dual-polarized omni-directional antenna and the broadband dual-polarized omni-directional antenna according to the present disclosure has a good polarization isolation effect and a uniform coverage, which may cover 2G, 3G, WLAN (Wireless LAN) and LTE (Long Term Evolution) systems effectively and may have the performance of MINO antenna in the LTE and WLAN systems, thus improving the data transmission rate.

BRIEF DESCRIPTION OF THE DRAWINGS

In order to illustrate technical solutions according to the embodiments of the present disclosure or according to the traditional technology more clearly, the accompanied drawings needed in describing the embodiments or the traditional technology will be described briefly. It is apparent that the accompanied drawings only represent some embodiments of the present disclosure and those skilled in the art may obtain other drawings according to the accompanied drawings without creative labor.

FIG. 2(*b*) is a main view of a broadband dual-polarized omni-directional antenna according to the first embodiment of the present disclosure;

FIG. 2(*c*) is a top view of a broadband dual-polarized omni-directional antenna according to the first embodiment of the present disclosure;

DETAILED DESCRIPTION OF THE PREFERRED EMBODIMENTS

Embodiments of the present disclosure provide a broadband dual-polarized omni-directional antenna and a feeding method using the same. The antenna has a dual-polarized structure comprising a horizontally polarized antenna and a vertically polarized antenna so as to improve a working efficiency of the antenna. According to the embodiments, the horizontally polarized antenna may work at a frequency ranging from 1710 MHz to 2700 MHz. In addition, the vertically polarized antenna may work at a frequency ranging from 1710 MHz to 2700 MHz and ranging from 820 MHz to 960 MHz depending on different networks so as to cover 2G, 3G, WLAN and LTE systems at the same time.

The technical solutions of the present disclosure will be described in detail with reference to the drawings and embodiments.

The First Embodiment

Figure 1:
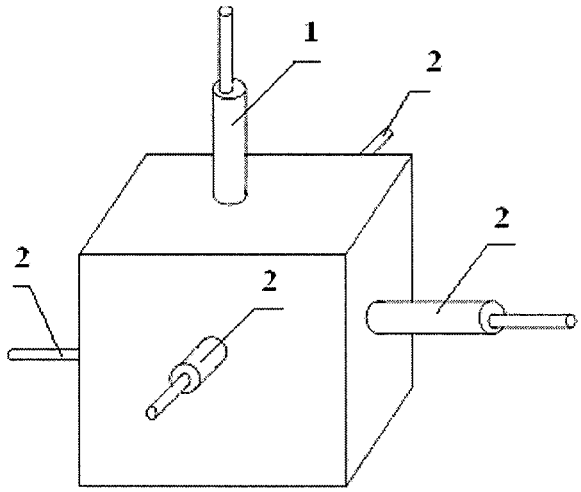
FIG. 1 is a schematic diagram showing a structure of a dual-polarized omni-directional antenna according to the prior art.
Figure 2A:
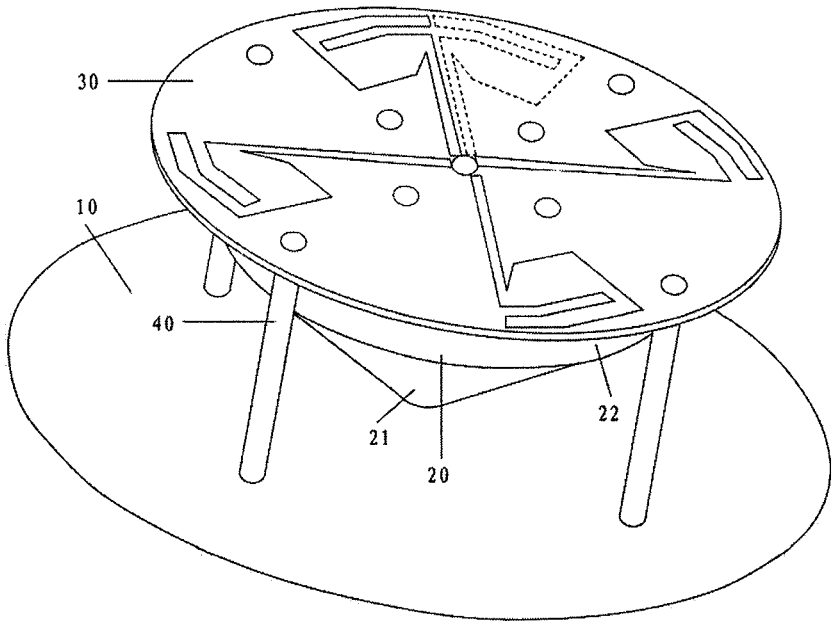
FIG. 2(*a*) is a perspective view of a broadband dual-polarized omni-directional antenna according to the first embodiment of the present disclosure.
Figure 2B:
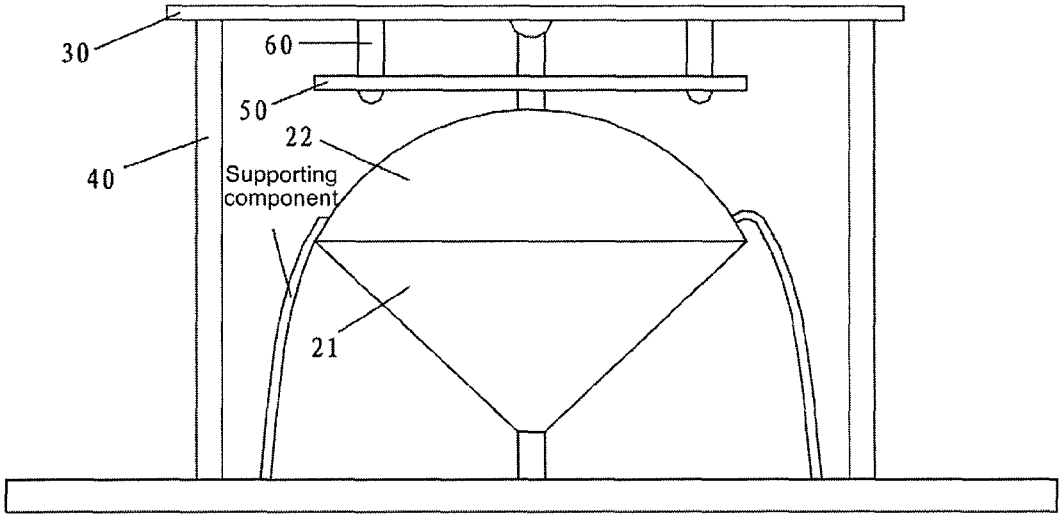
Figure 2C:
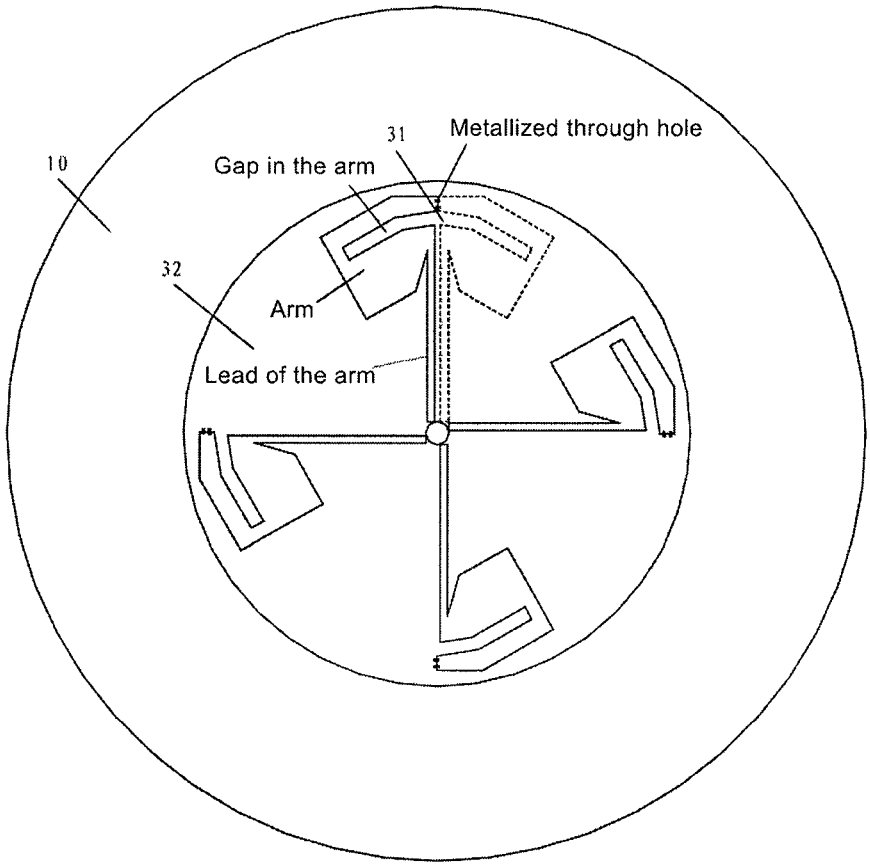

FIG. 2(*a*), FIG. 2(*b*) and FIG. 2(*c*) are a perspective view, a main view and a top view of a broadband dual-polarized omni-directional antenna according to the first embodiment of the present disclosure respectively.

The broadband dual-polarized omni-directional antenna according to the first embodiment of the present disclosure includes a substrate 10, a vertically polarized antenna 20, a horizontally polarized antenna 30 and a supporting pillar 40. The vertically polarized antenna 20 is disposed vertically on the substrate 10, the vertically polarized antenna 20 and the horizontally polarized antenna 30 are set co-axially, and the supporting pillar 40 is fixed on the substrate 10 and the horizontally polarized antenna 30 and the supporting pillar 40 is adapted to support the horizontally polarized antenna 30.

In addition to supporting the attaching plate 32, the supporting pillar 40 may help to adjust a standing wave by adjusting a height of the supporting pillar 40 so as to extend a frequency bandwidth of the antenna.

The supporting pillar 40 is made of an insulation material and is fixed on the attaching plate 32 and the substrate 10 by welding or riveting.

The substrate 10 helps to improve a directionality of an antenna array and to reduce a backward radiation. The substrate 10 may be a circular plane plate. A material of the substrate 10 may be a conductor and may be a metal substrate or a substrate with a metal layer such as a copper or an iron layer overlapped or coated on a top. Preferably, the substrate 10 may be a copper substrate or an aluminium substrate.

The horizontally polarized antenna 30 is for receiving and transmitting horizontally polarized waves and includes an attaching plate 32 and a folded dipole 31 attached to the attaching plate 32 for receiving and transmitting electromagnetic waves. Two arms of the folded dipole 31 are attached to an upper surface and a lower surface of the attaching plate 32 respectively, with one arm connecting to an inner conductor of a first feed line and the other arm connecting to an outer conductor the first feed line.

A number of the folded dipole 31 may be more than one. Preferably, the horizontally polarized antenna 30 may include an even number of folded dipoles 31. A plurality of folded dipoles 31 may be distributed on the attaching plate 32 uniformly and in an axial symmetry. For example, the horizontally polarized antenna 30 may include 4 folded dipoles 31 with adjacent two folded dipoles forming an angle of 90 degrees so as to reduce an ovality of the horizontal polarization.

The folded dipole 31 is formed by two symmetric arms. The two arms of the folded dipole 31 may be connected in different ways. Specifically, in the embodiment of the present disclosure, the two arms are connected through a metallized through hole. The metallized through hole is a hole through the attaching plate and on an inner surface of the hole, the metal layer such as the copper layer and the iron layer is disposed by processes such as overlapping or coating so as to be conductive. The hole is connected to both the arms on the upper and lower surface of the attaching plate so that the two arms are connected through the conductive hole on the attaching plate.

In order to guarantee a coverage broadness of the antenna, usually it is required that the ovality (a gain difference between a maximum gain direction and a minimum gain direction on a directional diagram plane having an approximately circular shape) of the antenna is less than 2 dB. In the first embodiment of the present disclosure, in order to reduce the ovality of the antenna, the arms of the folded dipole 31 may be in a form of a segment of circular ring or nearly circular ring. In addition, the arms may have a gap inside and the gap may be in a form of a segment of circular ring or nearly circular ring.

Figure 3:
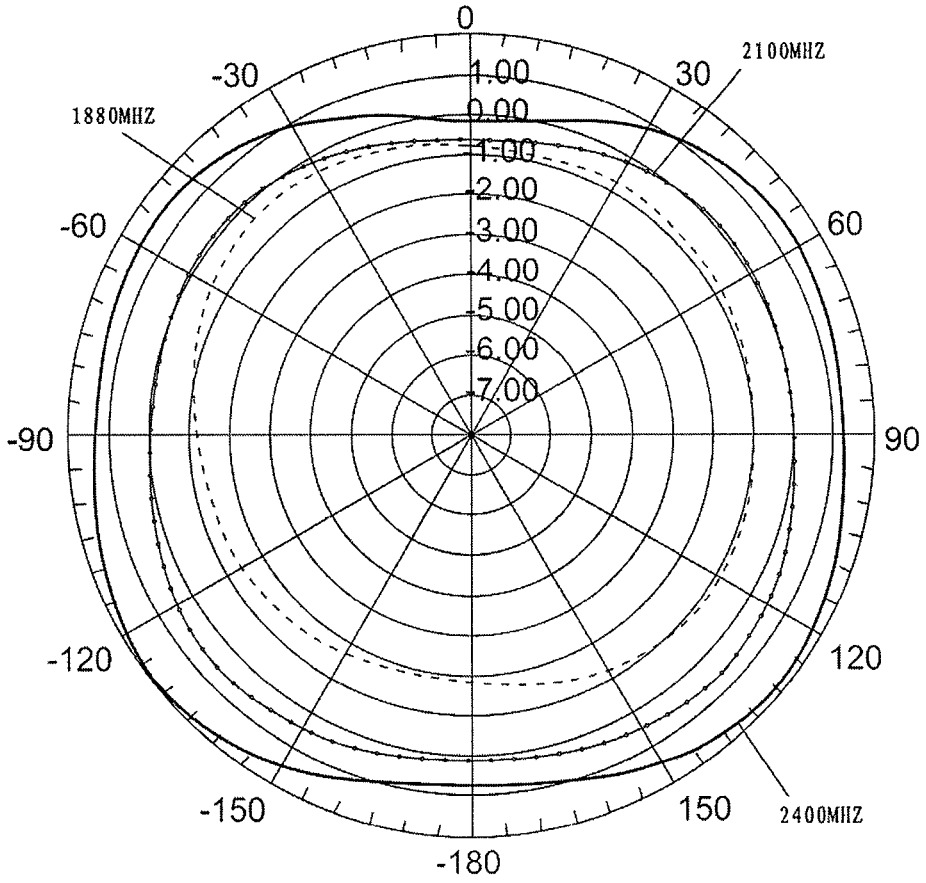
FIG. 3 is a directional diagram showing a horizontal polarization in a horizontal plane for a broadband dual-polarized omni-directional antenna according to the first embodiment of the present disclosure.
Figure 4:
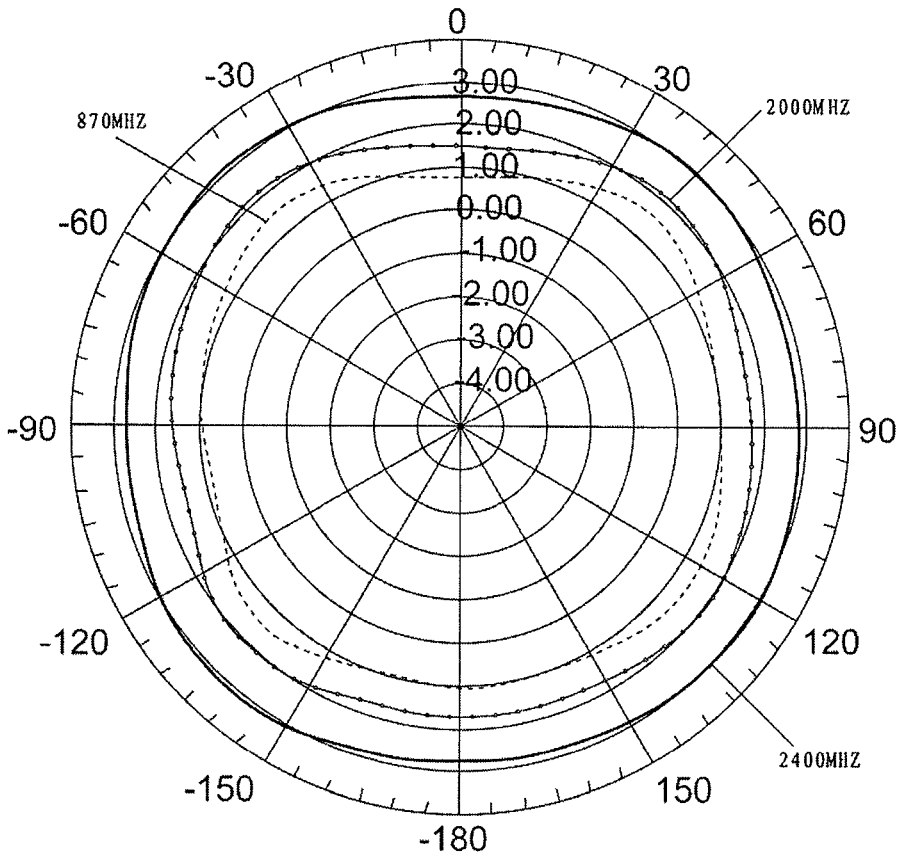
FIG. 4 is a directional diagram showing a vertical polarization direction in a vertical plane for a broadband dual-polarized omni-directional antenna according to the first embodiment of the present disclosure.

The nearly circular ring of the arm or the gap inside the arm of the folded dipole means that an outer edge of the arm (an outer circle of the ring) and an inner edge of the arm (an inner circle of the ring) may be in a form of a nearly arc composed by a plurality of segments. Specifically, as shown in FIG. 2(*c*) (the dashed line represents the arms of the folded dipole on the lower surface of the attaching plate and here the dashed line is used to only represent one arm of the folded dipole on the lower surface of the attaching plate and the other three arms are not shown). The arm of the folded dipole 31 is designed to be a segment of nearly circular ring and the gap inside the arm is designed to be a segment of nearly circular ring. FIG. 3 is a directional diagram showing a horizontal polarization in a horizontal plane for a broadband dual-polarized omni-directional antenna according to the first embodiment of the present disclosure. As shown in FIG. 3, the directional diagrams of the horizontal polarization in the horizontal plane for the antenna when working at 1880 MHz, 2100 MHz and 2400 MHz are represented by a dashed line, a dotted line and a solid line respectively. As shown in the figure, the ovality of the broadband dual-polarized omni-directional antenna in the horizontal direction is less than 2 dB, which is a general requirement for ovality for the antennas. FIG. 4 is a directional diagram showing a vertical polarization direction in a vertical plane for a broadband dual-polarized omni-directional antenna according to the first embodiment of the present disclosure. As shown in FIG. 4, the directional diagrams of the vertical polarization in the vertical plane for the antenna when working at 870 MHz, 2000 MHz and 2400 MHz are represented by a dashed line, a dotted line and a solid line respectively. As shown in the figure, the ovality of the broadband dual-polarized omni-directional antenna in the vertical direction is less than 2 dB.

An impedance of the folded dipole changes with a change of an area of the arm. Therefore, the impedance of the folded dipole may be adjusted by adjusting the area of the arm. Since the folded dipole has a large impedance, when the horizontally polarized antenna 30 includes multiple folded dipoles 31, the impedance of the horizontally polarized antenna may be matched with a impedance of the feed line by connecting the folded dipoles 31 in parallel so as to reduce the standing wave ratio (ratio between the maximum voltage and the minimum voltage) of the broadband dual-polarized omni-directional antenna provided in the first embodiment of the present disclosure.

Specifically, when the folded dipole 31 is connected with the first feed line, a lead in the arm of the folded dipole 31 is led from an inner edge of the arm and is connected to the inner conductor or the outer conductor of the first feed line. Leads of each folded dipole 31 connecting to the inner conductor of the first feed line are connected together and leads connecting to the outer conductor of the first feed line are connected together so that the folded dipoles 31 are connected in parallel. Further, for the convenience of connection, the arms of the multiple folded dipoles 31 connecting to the inner conductor of the first feed line may be set on the upper surface (or lower surface) of the attaching plate 32 and the leads connecting to the inner conductor of the first feed line may be connected together; the arms of the multiple folded dipoles 31 connecting to the outer conductor of the first feed line may be set on the lower surface (or upper surface) of the attaching plate and the leads connecting to the outer conductor of the first feed line may be connected together. Thus the multiple folded dipoles 31 are connected in parallel and the number of connecting lines may be reduced.

A shape of the attaching plate 32 includes but is not limited to circular, rectangular or other polygons. Preferably, the attaching plate 32 is designed to be circular. The two arms of the folded dipole 31 may be but not limited to be welded to the surface of the attaching plate 32. An outer edge of the arm of the folded dipole 31 is adjacent to an outer edge of the attaching plate 32 and an inner edge of the arm is adjacent to a center of the attaching plate 32.

The vertically polarized antenna 20 is used for receiving and transmitting vertically polarized waves. A material of the vertically polarized antenna 20 may be of a metal structure or structures with a copper or an iron layer overlapped or coated on a surface. Preferably, the vertically polarized antenna 20 may be a copper structure or an aluminium structure. The vertically polarized antenna 20 may have different structures. Specifically, as shown in FIG. 2(*a*) (the dashed line represents the arm of the folded dipole on the lower surface of the attaching plate and here the dashed line is used to only represent one arm of the folded dipole on the lower surface of the attaching plate and the other three arms are not shown), the vertically polarized antenna 20 includes an antenna component 22 in a form of spherical segment and an antenna component 21 in a form of cone extending from a lower end of the antenna component 22 in the form of spherical segment, and the antenna component 21 in the form of cone is connected with a second feed line. Specifically, feed points on the antenna component 21 in a form of cone may be connected with the second feed line through the round hole on the substrate 10 and the antenna component 21 in a form of cone is integrated with the substrate 10 through the hole and the second feed line that passes through the hole.

As shown in FIG. 2(*b*), the first feed line may come in through a side surface of the antenna component 22 in the form of spherical segment and come out through a top end of the antenna component 22 in the form of spherical segment so as to connect with lead of the arm of the folded dipole through an opening on a vertically polarized guide sheet 50. Preferably, as shown in FIG. 2(*b*), one supporting component may be added to support the vertically polarized antenna 20.

In order to reduce interference between the horizontally polarized antenna 30 and the vertically polarized antenna 20 and to improve a polarization isolation of the broadband dual-polarized omni-directional antenna provided in the first embodiment of the present disclosure, the horizontally polarized antenna 30 and the vertically polarized antenna 20 may be set co-axially. In order to reduce a coupling between the horizontally polarized antenna 30 and the vertically polarized antenna 20, a distance between the lower surface of the attaching plate 32 of the horizontally polarized antenna 30 and the vertically polarized antenna 20 may be set in a range from 8 mm to 15 mm. For example, when the vertically polarized antenna includes the antenna component 22 in a form of spherical segment and the antenna component 21 in a form of cone extending from a lower end of the antenna component 22 in the form of spherical segment, the vertical distance between the lower surface of the attaching plate 32 of the horizontally polarized antenna 30 and a top end of the antenna component 22 in a form of spherical segment of the vertically polarized antenna 20 ranges from 8 mm to 15 mm.

In order to broaden the bandwidth of the vertically polarized antenna 20 and to further reduce the coupling between the horizontally polarized antenna 30 and the vertically polarized antenna 20, as shown in FIG. 2(*b*), the first embodiment of the present disclosure provides a broadband dual-polarized omni-directional antenna which further includes a vertically polarized guide sheet 50 and a connecting component 60. The connecting component 60 is made from a non-conductive material and is fixed on the attaching plate 32 and the coupling component 50 by welding or riveting so that the vertically polarized guide sheet 50 is located between the horizontally polarized antenna and the vertically polarized antenna. That is to say, the upper surface of the vertically polarized guide sheet 50 is not in contact with the lower surface of the attaching plate 32 of the horizontally polarized antenna 30 and the lower surface of the vertically polarized guide sheet 50 is not in contact with the vertically polarized antenna either. The vertically polarized guide sheet 50 may be but not limited to in a form of circle. Specifically, the vertically polarized guide sheet may be designed to be circle.

By setting the vertically polarized guide sheet 50 between the vertically polarized antenna 20 and the horizontally polarized antenna 30, the bandwidth of the vertically polarized antenna 20 may be broadened and the coupling between the vertically polarized antenna 20 and the horizontally polarized antenna 30 may be reduced.

The Second Embodiment

The second embodiment of the present disclosure provides a feeding method using the broadband dual-polarized omni-directional antenna according to the first embodiment. According to the method, the horizontally polarized antenna is used to receive horizontal polarized waves and the vertically polarized antenna is used to receive vertical polarized waves. The received radio waves are converted to a high frequency current and then output through the first feed line and the second feed line. According to the method, the received high frequency current is converted into the radio waves and then output through the first feed line and the second feed line to the antenna; the horizontally polarized antenna is used to transmit the horizontal polarized waves and the vertically polarized antenna is used to transmit the vertical polarized waves.

In addition to the advantages of high frequency band coverage and high data transmission rate, the broadband dual-polarized omni-directional antenna provided in the embodiment of the present disclosure has the advantage of reducing the ovality of the broadband dual-polarized omni-directional antenna by mounting the multiple folded dipoles on the attaching plate in symmetry and by designing the arm of the folded dipoles to a segment of circular ring or by designing a gap in a form of a segment of circular ring in the arm. By connecting the multiple folded dipoles in parallel, the standing wave of the broadband dual-polarized omni-directional antenna can be reduced. By setting the arms connecting the inner conductor of the feed line on the same surface of the attaching plate, the number of the connecting lines can be reduced. According to the embodiment of the present disclosure, by setting the vertically polarized guide sheet 50 between the vertically polarized antenna 20 and the horizontally polarized antenna 30, the bandwidth of the vertically polarized antenna 20 can be broadened and the coupling between the vertically polarized antenna 20 and the horizontally polarized antenna 30 can be reduced so that the performance of the broadband dual-polarized omni-directional antenna can be optimized.

In addition to working as the MIMO antenna in the TD-LTE and WLAN systems, the dual-polarized omni-directional antenna provided in the embodiment of the present disclosure may cover frequency bands of the GSM, CDMA, WCDMA, CDMA2000, TD-SCDMA, TD-LTE and WLAN by using the vertically polarized dipole as the traditional mono-polarized (ceiling) antenna, which may be independently used in the GSM and CDMA indoor coverage systems. In the 3G systems such as the WCDMA, CDMA2000 and TD-SCDMA systems, the vertically polarized dipole and the horizontally polarized dipole of the dual-polarized omni-directional antenna may be combined to form a dual channel antenna for receiving and transmitting the radio waves. That is to say, by using the technical solutions provided in the embodiments of the present disclosure, the uplink and downlink signal transmission quality may be improved for different kinds of networks such as GSM, CDMA, WCDMA, TD-SCDMA, LTE and WLAN. In the LTE and WLAN in compliance with 802.11n, the MIMO antenna technology may be used directly by using the multiple antennas and multiple channels provided in the embodiments of the present disclosure, the uplink and downlink coverage and the transmission rate of the indoor distribution system may be improved. Therefore, the embodiments of the present disclosure may be used in the 2G, 3G and WLAN systems at the same time and may be smoothly used in the LTE system, which has the function of covering all the current indoor distribution systems.

Figure 5:
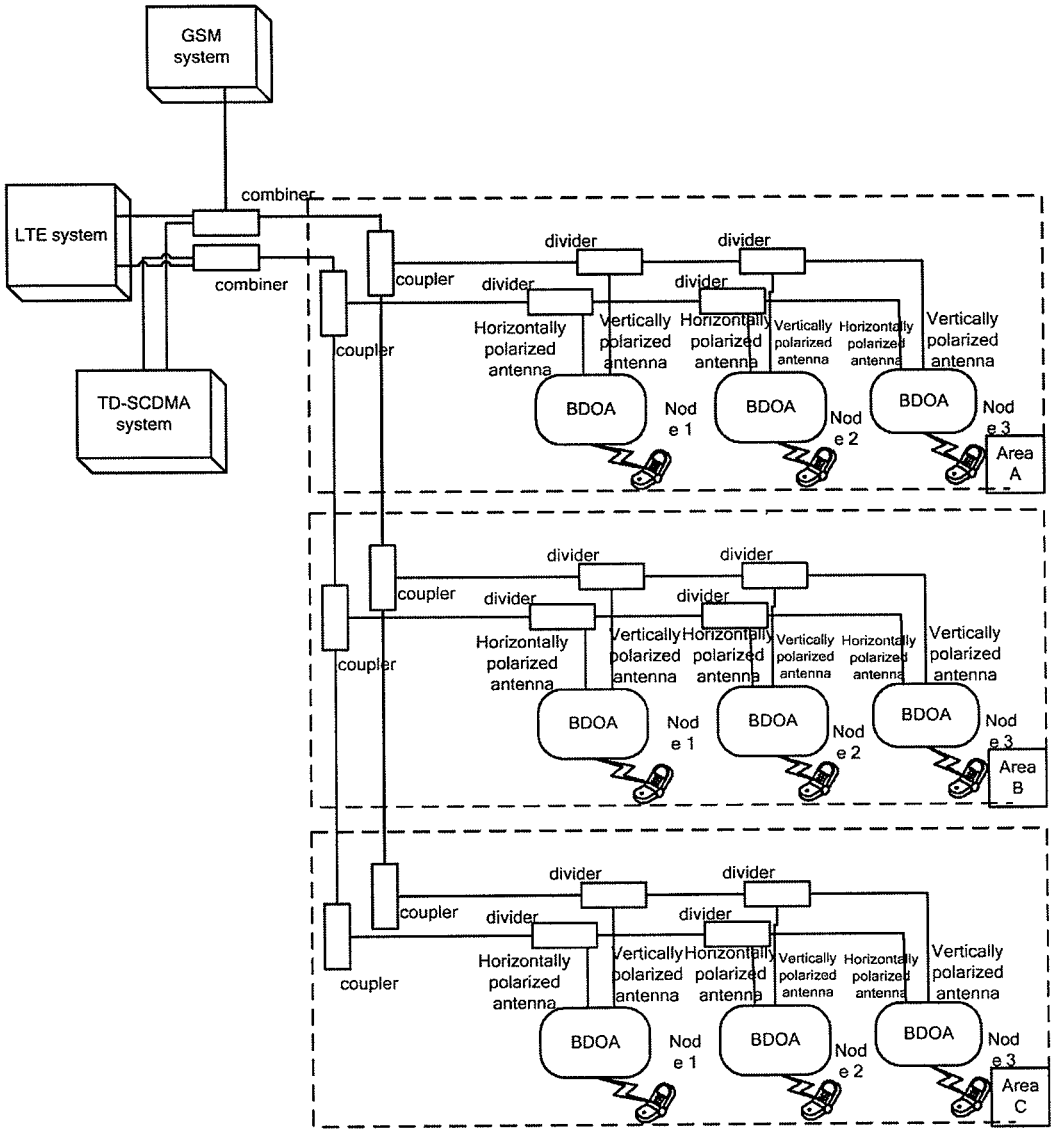
FIG. 5 is a schematic diagram showing an indoor distribution system shared by LTE, GSM and TD-SCDMA with the broadband dual-polarized omni-directional antenna according to the present disclosure applied.

For example, as shown in FIG. 5, the broadband dual-polarized omni-directional antenna according to the embodiment of the present disclosure may be applied in an indoor distribution system shared by LTE, GSM and TD-SCDMA. As shown in FIG. 5, the shared indoor distribution system is distributed in area A, area B and area C where one broadband dual-polarized omni-directional antenna according to the embodiment of the present disclosure may be arranged in each radiating node, in which the vertically polarized antenna may cover the frequency band of 820 MHz~960 MHz and 1710 MHz~2700 MHz while the horizontally polarized antenna may cover the frequency band of 1710 MHz~2700 MHz.

Next, area A will be taken as an example to illustrate the procedure of using the broadband dual-polarized omni-directional antenna for area A according to the embodiment of the present disclosure.

When a TD-SCDMA terminal needs to transmit an uplink signal, for example when the 1880~1920 MHz and 2010~2025 MHz frequency bands are used, an antenna covering both 1880~1920 MHz and 2010~2025 MHz frequency bands should be selected from the indoor dual-polarized omni-directional antenna.

It is assumed that in area A in each dual-polarized omni-directional antenna radiation node (node 1, node 2 and node 3), both the vertically polarized antenna and the horizontally polarized antenna may cover the 1880~1920 MHz and 2010~2025 MHz frequency bands, i.e. in each node within area A there are two polarized antennas covering the 1880~1920 MHz and 2010~2025 MHz frequency bands. Therefore, two differently polarized antennas (i.e. vertically polarized antenna and horizontally polarized antenna) covering both the 1880~1920 MHz and 2010~2025 MHz frequency bands may be selected from the radiation node 1.

When the two antennas for receiving the uplink signals transmitted from the TD-SCDMA terminal are determined, they begin to receive the uplink signals transmitted from the TD-SCDMA terminal respectively and combine the two path signals received in diversity into one path uplink signal and the procedure for combining the signals is described below.

In radiation node 1, the vertically polarized antenna and the horizontally polarized antenna receive two path uplink signals in diversity and transmit the signals through their own channels respectively.

The uplink signals transmitted in the channel corresponding to the horizontally polarized antenna and the uplink signals transmitted in the channel corresponding to the vertically polarized antenna are transmitted to an uplink signal destination TD-SCDMA network element (such as the TD-SCDMA base station) of the TD-SCDMA terminal together through the RRU and BBU of the dual channels and are combined into one path uplink signal at the base station. The destination TD-SCDMA network element combines the received uplink signals into one path signal and realizes receiving the uplink signals transmitted by the TD-SCDMA terminal together by using the dual-polarized omni-directional antenna that may be integrated with one vertically polarized antenna and one horizontally polarized antenna.

When an LTE terminal needs to transmit an uplink signal, for example when the 2300 MHz~2400 MHz frequency band is used, one vertically polarized antenna and one horizontally polarized antenna both covering 2300 MHz~2400 MHz frequency band may be selected in radiation node 1 with in area A to utilize the MIMO antenna technology to improve the network coverage and the data transmission rate and the detailed method will not be illustrated in detail here.

Apparently, those skilled in the art may make any changes, alternatives and modifications to the present disclosure without departing from spirit and principles of the disclosure. Thus when the changes, alternatives, and modifications belong to the scope of protected by the claims and the equivalent, the present disclosure intends to include the changes, alternatives and modifications.

What is claimed is:

1. A broadband dual-polarized omni-directional antenna, wherein the broadband dualpolarized omni-directional antenna comprises a vertically polarized antenna (20) and a horizontally polarized antenna (30) each set in co-axial; the horizontally polarized antenna (30) comprises an attaching plate (32) and a folded dipole (31) attached to the attaching plate (32) for receiving and transmitting electromagnetic waves; two arms of the folded dipole (31) are attached to an upper surface and a lower surface of the attaching plate (32) respectively, with one arm connecting to an inner conductor of a first feed line and the other arm connecting to an outer conductor the first feed line.

2. The broadband dual-polarized omni-directional antenna according to claim 1, wherein the two arms of the folded dipole are connected through a metallized through hole.

3. The broadband dual-polarized omni-directional antenna according to claim 1, wherein the antenna further comprises a vertical polarized guide sheet (50) and a connecting component (60); the connecting component (60) connects the attaching plate (32) of the horizontally polarized antenna (30) with the vertical polarized guide sheet (50) to have the vertical polarized guide sheet (50) fixed between the horizontally polarized antenna and the vertically polarized antenna.

4. The broadband dual-polarized omni-directional antenna according to claim 1, wherein the vertically polarized antenna (20) comprises an antenna component (22) in a form of spherical segment and an antenna component (21) in a form of cone extending from a lower end of the antenna component (22) in the form of spherical segment, and the antenna component (21) in the form of cone is connected with a second feed line.

5. The broadband dual-polarized omni-directional antenna according to claim 4, wherein a vertical distance between the lower surface of the attaching plate (32) of the horizontally polarized antenna (30) and a top end of the antenna component (22) in the form of spherical segment of the vertically polarized antenna (20) ranges between 8 mm and 15 mm.

6. The broadband dual-polarized omni-directional antenna according to claim 1, wherein the arms are in a polygon in a form of a segment of circular ring or nearly circular ring and leads in the arms are led from an inner edge of the arms and are connected to the inner conductor or the outer conductor of the first feed line.

7. The broadband dual-polarized omni-directional antenna according to claim 6, wherein the horizontally polarized antenna (30) comprises N folded dipoles (31), where N is an even number and the N folded dipoles (31) are arranged uniformly on the attaching plate (32) in an axial symmetry.

8. The broadband dual-polarized omni-directional antenna according to claim 7, wherein an outer edge of the arm of the folded dipole (31) is adjacent to an outer edge of the attaching plate (32) and an inner edge of the arm is adjacent to a center of the attaching plate (32).

9. The broadband dual-polarized omni-directional antenna according to claim 8, wherein leads of each folded dipole (31) connecting to the inner conductor of the first feed line are connected together and leads connecting to the inner conductor of the first feed line are connected together so that the N folded dipoles (31) are connected in parallel.

10. The broadband dual-polarized omni-directional antenna according to claim 6, wherein a gap in a form of a segment of circular ring or a segment of approximately circular ring exists in the arm.

11. The broadband dual-polarized omni-directional antenna according to claim 1, wherein the vertical polarized antenna is applied in an indoor GSM coverage system and an indoor CDMA coverage system; when the broadband dual-polarized omni-directional antenna is applied in a WCDMA system, a CDMA2000 system or a TD-SCDMA system, the vertically polarized antenna and the horizontally polarized antenna together form a dual-channel antenna; when the broadband dual-polarized omni-directional antenna is applied in a TD-LTE system or a WLAN system, the broadband dual-polarized omni-directional antenna is an MIMO antenna.

12. A feeding method using the broadband dual-polarized omni-directional antenna according to claim 1, wherein the method comprises: using the horizontally polarized antenna to receive and transmit horizontal polarized waves; using the vertically polarized antenna to receive and transmit vertical polarized waves.

* * * * *